US011610525B2

(12) United States Patent
Lv

(10) Patent No.: US 11,610,525 B2
(45) Date of Patent: Mar. 21, 2023

(54) DRIVING CIRCUIT AND DISPLAY PANEL

(71) Applicant: TCL CHINA STAR OPTOELECTRONICS TECHNOLOGY CO., LTD., Guangdong (CN)

(72) Inventor: Xiaowen Lv, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 453 days.

(21) Appl. No.: 16/755,816

(22) PCT Filed: Mar. 10, 2020

(86) PCT No.: PCT/CN2020/078555
§ 371 (c)(1),
(2) Date: Apr. 13, 2020

(87) PCT Pub. No.: WO2021/168908
PCT Pub. Date: Sep. 2, 2021

(65) Prior Publication Data

US 2022/0309975 A1 Sep. 29, 2022

(30) Foreign Application Priority Data

Feb. 24, 2020 (CN) ..... 202010112340.9

(51) Int. Cl.
*G09G 3/20* (2006.01)

(52) U.S. Cl.
CPC ..... *G09G 3/20* (2013.01); *G09G 2310/0202* (2013.01); *G09G 2310/0267* (2013.01); *G09G 2310/0286* (2013.01); *G09G 2310/08* (2013.01)

(58) Field of Classification Search
None
See application file for complete search history.

(56) References Cited

U.S. PATENT DOCUMENTS

| | | | | |
|---|---|---|---|---|
| 10,049,636 | B2 * | 8/2018 | Xu | G11C 19/28 |
| 10,217,430 | B1 * | 2/2019 | L V | G09G 3/3677 |
| 10,332,468 | B2 * | 6/2019 | Xu | G09G 3/3677 |
| 2014/0103983 | A1 * | 4/2014 | Chang | G11C 19/28 327/198 |
| 2015/0102990 | A1 * | 4/2015 | Kuo | G09G 3/3677 327/109 |
| 2016/0343321 | A1 | 11/2016 | Xiao | |

(Continued)

FOREIGN PATENT DOCUMENTS

| | | | |
|---|---|---|---|
| CN | 103077689 | A | 5/2013 |
| CN | 104464657 | A | 3/2015 |

(Continued)

*Primary Examiner* — Dorothy Harris
(74) *Attorney, Agent, or Firm* — PV IP PC; Wei Te Chung; Ude Lu

(57) ABSTRACT

The present invention provides a driving circuit and a display panel including at least two gate driving units, and at least two of the gate driving units are connected in a cascade arrangement. an Nth stage driving unit in the at least two of the gate driving units includes a pull-up control module, a pull-up module, a pull-down module, a pull-down maintaining module, and a bootstrap capacitor, wherein N is an integer greater than 0.

14 Claims, 5 Drawing Sheets

(56) References Cited

U.S. PATENT DOCUMENTS

| | | | | |
|---|---|---|---|---|
| 2018/0061349 | A1* | 3/2018 | Xu | G11C 19/28 |
| 2018/0182339 | A1 | 6/2018 | Zeng | |
| 2018/0330687 | A1 | 11/2018 | Zeng | |
| 2019/0019442 | A1* | 1/2019 | Xu | G09G 3/3677 |

FOREIGN PATENT DOCUMENTS

| | | | |
|---|---|---|---|
| CN | 105957480 | A | 9/2016 |
| CN | 106057152 | A | 10/2016 |
| CN | 106128397 | A | 11/2016 |
| CN | 106409262 | A | 2/2017 |
| CN | 106486080 | A | 3/2017 |
| CN | 107610668 | A | 1/2018 |
| CN | 109192157 | A | 1/2019 |
| CN | 109448624 | A | 3/2019 |
| CN | 109637423 | A | 4/2019 |
| JP | H08148985 | A | 6/1996 |

* cited by examiner

DRIVING CIRCUIT AND DISPLAY PANEL

FIELD OF INVENTION

The present disclosure relates to the field of display technology, and more particularly, to an array circuit and a display panel.

BACKGROUND OF INVENTION

Gate driver on array (GOA) technology integrates gate driving circuits on an array substrate of display panels, thereby omitting a part of the gate driving integrated circuits and achieving a technique of driving method progressive scanning of gates.

At present, GOA circuits and signal lines are concentrated in display regions of display panels, which cause intermediate wiring complexity and are unfavorable to a narrow frame design.

Thus, a new technical solution needs to be provided to solve the above technical problems.

SUMMARY OF INVENTION

An embodiment of the present disclosure provides a driving circuit and a display panel for reducing wiring space of the driving circuit in the display panel.

The present disclosure provides a driving circuit, and the driving circuit comprises at least two gate driving units, wherein at least two of the gate driving units are connected in a cascade arrangement.

An Nth stage driving unit in the at least two of the gate driving units comprises a pull-up control module, a pull-up module, a pull-down module, a pull-down maintaining module, and a bootstrap capacitor, wherein N is an integer greater than 0.

The pull-up control module is connected to an output terminal of an (N−1)th stage scanning signal of the driving circuit and is connected to a first node in the Nth stage driving unit, and is used to output a scanning signal at the output terminal of the (N−1)th stage scanning signal to the first node.

The pull-up module is connected to an input terminal of a clock signal and is connected to the first node, and is used to pull up a potential of a scanning signal at an output terminal of an Nth stage scanning signal of the driving circuit under a potential control of the first node.

The pull-down module is connected to an input terminal of an (N+1)th stage scanning signal of the driving circuit and an input terminal of a reference low-stage signal of the driving circuit and is connected to the first node and the output terminal of an Nth stage scanning signal, and is used to pull down a potential of the first node and a potential of the scanning signal at the output terminal of the Nth stage scanning signal according to a scanning signal at the input terminal of the (N+1)th stage scanning signal and the potential of the scanning signal at the output terminal of the Nth stage scanning signal.

The pull-down maintaining module is connected to an input terminal of a first control signal, an input terminal of a second control signal, and the input terminal of the reference low-stage signal and is connected to the first node and the output terminal of the Nth stage scanning signal, and is used to maintain the potential of the first node and the potential of the scanning signal at the output terminal of the Nth stage scanning signal at a potential of a signal at the input terminal of the reference low-stage signal after the pull-down module pulls down the potential of the first node and the potential of the scanning signal at the output terminal of the Nth stage scanning signal.

One terminal of the bootstrap capacitor is connected to the first node, and another terminal of the bootstrap capacitor is connected to the output terminal of the Nth stage scanning signal.

In the driving circuit of the present disclosure, the Nth stage driving unit further comprises a download module, the download module is connected to the input terminal of the clock signal and is connected to the first node, and is used to output a stage-transmitting signal at an output terminal of an Nth stage-transmitting signal of the driving circuit under the potential control of the first node.

In the driving circuit of the present disclosure, the pull-up control module comprises a first transistor, an input terminal of the first transistor and a gate of the first transistor are both connected to the output terminal of the (N−1)th stage scanning signal, and an output terminal of the first transistor is connected to the first node.

In the driving circuit of the present disclosure, the pull-up module comprises a second transistor, an input terminal of the second transistor is connected to the input terminal of the clock signal, a gate of the second transistor is connected to the first node, and an output terminal of the second transistor is connected to the output terminal of the Nth stage scanning signal.

In the driving circuit of the present disclosure, the pull-down module comprises a third transistor and a fourth transistor, an input terminal of the third transistor and an input terminal of the fourth transistor are connected to the input terminal of the reference low-stage signal, an output terminal of the third transistor is connected to the output terminal of the Nth stage scanning signal, an output terminal of the fourth transistor is connected to the first node, and a gate of the third transistor and a gate of the fourth transistor are both connected to the input terminal of the (N+1)th stage scanning signal.

In the driving circuit of the present disclosure, the first pull-down maintaining sub-module comprises a first maintaining transistor, a second maintaining transistor, a third maintaining transistor, a fourth maintaining transistor, a fifth maintaining transistor, and a sixth maintaining transistor.

An input terminal of the first maintaining transistor, a gate of the first maintaining transistor, and an input terminal of the second maintaining transistor are all connected to the input terminal of the first control signal. An output terminal of the first maintaining transistor and a gate of the second maintaining transistor are both connected to an output terminal of the third maintaining transistor. An input terminal of the third maintaining transistor, an input terminal of the fourth maintaining transistor, an input terminal of the fifth maintaining transistor, and an input terminal of the sixth maintaining transistor are all connected to the input terminal of the reference low-stage signal. An output terminal of the second maintaining transistor, a gate of the third maintaining transistor, an output terminal of the fourth maintaining transistor, a gate of the fourth maintaining transistor, and a gate of the fifth maintaining transistor, and an output terminal of the fifth maintaining transistor are all connected to the output terminal of the Nth stage scanning signal. An output terminal of the sixth maintaining transistor is connected to the first node.

The second pull-down maintaining sub-module comprises a seventh maintaining transistor, an eighth maintaining transistor, a ninth maintaining transistor, a tenth maintaining transistor, an eleventh maintaining transistor, a twelfth maintaining transistor.

An input terminal of the seventh maintaining transistor, an input terminal of the eighth maintaining transistor, and a gate of the eighth maintaining transistor are all connected to an input terminal of the second control signal. A gate of the seventh maintaining transistor and the output terminal of the eighth maintaining transistor are both connected to an output terminal of the ninth maintaining transistor. An input terminal of the ninth maintaining transistor, an input terminal of the tenth maintaining transistor, an input terminal of the eleventh maintaining transistor, and an input terminal of the twelfth maintaining transistor are all connected to the input terminal of the reference low-stage signal. An output terminal of the tenth maintaining transistor, a gate of the eleventh maintaining transistor, and a gate of the twelfth maintaining transistor are all connected to an output terminal of the seventh maintaining transistor. A gate of the ninth maintaining transistor, a gate of the tenth maintaining transistor, and an output terminal of the eleventh maintaining transistor are all connected to the output terminal of the Nth stage scanning signal. An output terminal of the twelfth maintaining transistor is connected to the first node.

In the driving circuit of the present disclosure, the download module comprises a first download transistor, an input terminal of the first download transistor is connected to the input terminal of the second transistor, a gate of the first download transistor is connected to the first node, and an output terminal of the first download transistor is connected to the stage-transmitting signal at the output terminal of the Nth stage-transmitting signal.

In the driving circuit of the present disclosure, when the input terminal of the first control signal is at a low stage, the input terminal of the second control signal is at a high stage; and when the input terminal of the first control signal is at a high stage, the input terminal of the second control signal is at a low stage.

The present disclosure further provides a display panel comprising a driving circuit and a pixel array, wherein the driving circuit comprises at least two gate driving units, and at least two of the gate driving units are connected in a cascade arrangement.

An Nth stage driving unit in the at least two of the gate driving units comprises a pull-up control module, a pull-up module, a pull-down module, a pull-down maintaining module, and a bootstrap capacitor, wherein N is an integer greater than 0.

The pull-up control module is connected to an output terminal of an (N−1)th stage scanning signal of the driving circuit and is connected to a first node in the Nth stage driving unit, and is used to output a scanning signal at the output terminal of the (N−1)th stage scanning signal to the first node.

The pull-up module is connected to an input terminal of a clock signal and is connected to the first node, and is used to pull up a potential of a scanning signal at an output terminal of an Nth stage scanning signal of the driving circuit under a potential control of the first node.

The pull-down module is connected to an input terminal of an (N+1)th stage scanning signal of the driving circuit and an input terminal of a reference low-stage signal of the driving circuit and is connected to the first node and the output terminal of an Nth stage scanning signal, and is used to pull down a potential of the first node and a potential of the scanning signal at the output terminal of the Nth stage scanning signal according to a scanning signal at the input terminal of the (N+1)th stage scanning signal and the potential of the scanning signal at the output terminal of the Nth stage scanning signal.

The pull-down maintaining module is connected to an input terminal of a first control signal, an input terminal of a second control signal, and the input terminal of the reference low-stage signal and is connected to the first node and the output terminal of the Nth stage scanning signal, and is used to maintain the potential of the first node and the potential of the scanning signal at the output terminal of the Nth stage scanning signal at a potential of a signal at the input terminal of the reference low-stage signal after the pull-down module pulls down the potential of the first node and the potential of the scanning signal at the output terminal of the Nth stage scanning signal.

One terminal of the bootstrap capacitor is connected to the first node, and another terminal of the bootstrap capacitor is connected to the output terminal of the Nth stage scanning signal.

In the display panel of the present disclosure, the Nth stage driving unit further comprises a download module, the download module is connected to the input terminal of the clock signal and is connected to the first node, and is used to output a stage-transmitting signal at an output terminal of an Nth stage-transmitting signal of the driving circuit under the potential control of the first node.

In the display panel of the present disclosure, the pull-up control module comprises a first transistor, an input terminal of the first transistor and a gate of the first transistor are both connected to the output terminal of the (N−1)th stage scanning signal, and an output terminal of the first transistor is connected to the first node.

In the display panel of the present disclosure, the pull-up module comprises a second transistor, an input terminal of the second transistor is connected to the input terminal of the clock signal, a gate of the second transistor is connected to the first node, and an output terminal of the second transistor is connected to the output terminal of the Nth stage scanning signal.

In the display panel of the present disclosure, the pull-down module comprises a third transistor and a fourth transistor, an input terminal of the third transistor and an input terminal of the fourth transistor are connected to the input terminal of the reference low-stage signal, an output terminal of the third transistor is connected to the output terminal of the Nth stage scanning signal, an output terminal of the fourth transistor is connected to the first node, and a gate of the third transistor and a gate of the fourth transistor are both connected to the input terminal of the (N+1)th stage scanning signal.

In the display panel of the present disclosure, the first pull-down maintaining sub-module comprises a first maintaining transistor, a second maintaining transistor, a third maintaining transistor, an fourth maintaining transistor, a fifth maintaining transistor, and a sixth maintaining transistor.

An input terminal of the first maintaining transistor, a gate of the first maintaining transistor, and an input terminal of the second maintaining transistor are all connected to the input terminal of the first control signal. An output terminal of the first maintaining transistor and a gate of the second maintaining transistor are both connected to an output terminal of the third maintaining transistor. An input terminal of the third maintaining transistor, an input terminal of the fourth maintaining transistor, an input terminal of the fifth maintaining transistor, and an input terminal of the sixth maintaining transistor are all connected to the input terminal of the reference low-stage signal. An output terminal of the second maintaining transistor, a gate of the third maintaining transistor, an output terminal of the fourth maintaining transistor, a gate of the fourth maintaining transistor, and a gate of the fifth maintaining transistor, and an output terminal of the fifth maintaining transistor are all connected to the output terminal of the Nth stage scanning signal. An output terminal of the sixth maintaining transistor is connected to the first node.

The second pull-down maintaining sub-module comprises a seventh maintaining transistor, an eighth maintaining transistor, a ninth maintaining transistor, a tenth maintaining transistor, an eleventh maintaining transistor, a twelfth maintaining transistor.

An input terminal of the seventh maintaining transistor, an input terminal of the eighth maintaining transistor, and a gate of the eighth maintaining transistor are all connected to an input terminal of the second control signal. A gate of the seventh maintaining transistor and the output terminal of the eighth maintaining transistor are both connected to an output terminal of the ninth maintaining transistor. An input terminal of the ninth maintaining transistor, an input terminal of the tenth maintaining transistor, an input terminal of the eleventh maintaining transistor, and an input terminal of the twelfth maintaining transistor are all connected to the input terminal of the reference low-stage signal. An output terminal of the tenth maintaining transistor, a gate of the eleventh maintaining transistor, and a gate of the twelfth maintaining transistor are all connected to an output terminal of the seventh maintaining transistor. A gate of the ninth maintaining transistor, a gate of the tenth maintaining transistor, and an output terminal of the eleventh maintaining transistor are all connected to the output terminal of the Nth stage scanning signal. An output terminal of the twelfth maintaining transistor is connected to the first node.

In the display panel of the present disclosure, the download module comprises a first download transistor, an input terminal of the first download transistor is connected to the input terminal of the second transistor, a gate of the first download transistor is connected to the first node, and an output terminal of the first download transistor is connected to the stage-transmitting signal at the output terminal of the Nth stage-transmitting signal.

In the display panel of the present disclosure, when the input terminal of the first control signal is at a low stage, the input terminal of the second control signal is at a high stage; and when the input terminal of the first control signal is at a high stage, the input terminal of the second control signal is at a low stage.

Compared with the prior art, driving units of a driving circuit in an embodiment of the present disclosure comprise a pull-up control module, a pull-up module, a pull-down module, a pull-down maintaining module, and a bootstrap capacitor. The pull-up control module and the pull-down module are connected to scanning lines to be used for outputting scanning signals. In the driving circuit provided by the embodiment of the present disclosure, stage-transmitting signal lines and control signal lines are simplified, and scanning signal lines are used to transmit signals. Since the scanning signal lines are internal scanning lines, design structure of circuits is greatly simplified, and wiring space of the driving circuit in the display panel is reduced without adding a new wiring. On the one hand, structural cost of the circuits is saved, and on the other hand, structural size of the driving circuit can be reduced, so that the display panel has a narrower frame structure.

DETAILED DESCRIPTION OF PREFERRED EMBODIMENTS

In order to make purposes, technical solutions, and advantages of the present disclosure clearer, the present disclosure will be further described in detail below with reference to accompanying drawings. Please refer to the drawings, same component symbols represent same components. The following description is based on specific embodiments shown in the present disclosure, which should not be construed as limiting other specific embodiments of the present disclosure which are not detailed here. The term "embodiment" used in the present specification means an example, instance, or illustration. Furthermore, the articles "a" and "an" used in the present specification and the appended claims can generally be construed as "one or more" unless specified otherwise or clear from context.

An embodiment of the present disclosure uses an Nth stage driving unit in gate driving units as an example.

Figure 1:
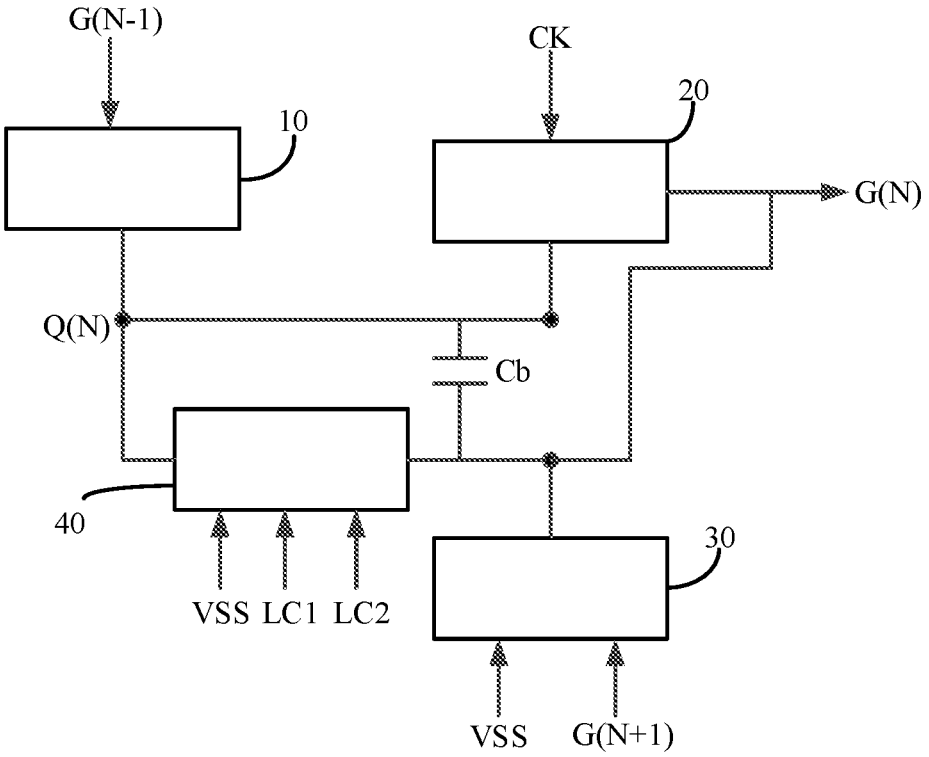
FIG. 1 is a schematic structural diagram of a driving circuit provided by an embodiment of the present disclosure.

As shown in FIG. 1, the embodiment of the present disclosure provides a driving circuit, and the driving circuit comprises at least two gate driving units, wherein at least two of the gate driving units are connected in a cascade arrangement An Nth stage driving unit in the at least two of the gate driving units comprises a pull-up control module 10, a pull-up module 20, a pull-down module 30, a pull-down maintaining module 40, and a bootstrap capacitor Cb, wherein N is an integer greater than 0.

Specifically, the pull-up control module 10 is connected to an output terminal G(N−1) of an (N−1)th stage scanning signal of the driving circuit and is connected to a first node Q(N) in the Nth stage driving unit, and is used to output a scanning signal at the output terminal G(N−1) of the (N−1)th stage scanning signal to the first node Q(N).

The pull-up module 20 is connected to an input terminal of a clock signal CK and is connected to the first node Q(N), and is used to pull up a potential of a scanning signal at an output terminal G(N) of an Nth stage scanning signal of the driving circuit under a potential control of the first node Q(N).

The pull-down module is connected to an input terminal G(N+1) of an (N+1)th stage scanning signal of the driving circuit and an input terminal VSS of a reference low-stage signal of the driving circuit and is connected to the first node Q(N) and the output terminal G(N) of an Nth stage scanning signal, and is used to pull down a potential of the first node Q(N) and a potential of the scanning signal at the output terminal G(N) of the Nth stage scanning signal according to a scanning signal at the input terminal G(N+1) of the (N+1)th stage scanning signal and the potential of the scanning signal at the output terminal G(N) of the Nth stage scanning signal.

The pull-down maintaining module 40 is connected to an input terminal LC1 of a first control signal, an input terminal LC2 of a second control signal, and the input terminal VSS of the reference low-stage signal and is connected to the first node Q(N) and the output terminal G(N) of the Nth stage scanning signal, and is used to maintain the potential of the first node Q(N) and the potential of the scanning signal at the output terminal G(N) of the Nth stage scanning signal at a potential of a signal at the input terminal VSS of the reference low-stage signal after the pull-down module pulls down the potential of the first node Q(N) and the potential of the scanning signal at the output terminal G(N) of the Nth stage scanning signal.

One terminal of the bootstrap capacitor Cb is connected to the first node Q(N), and another terminal of the bootstrap capacitor Cb is connected to the output terminal G(N) of the Nth stage scanning signal.

Figure 2:
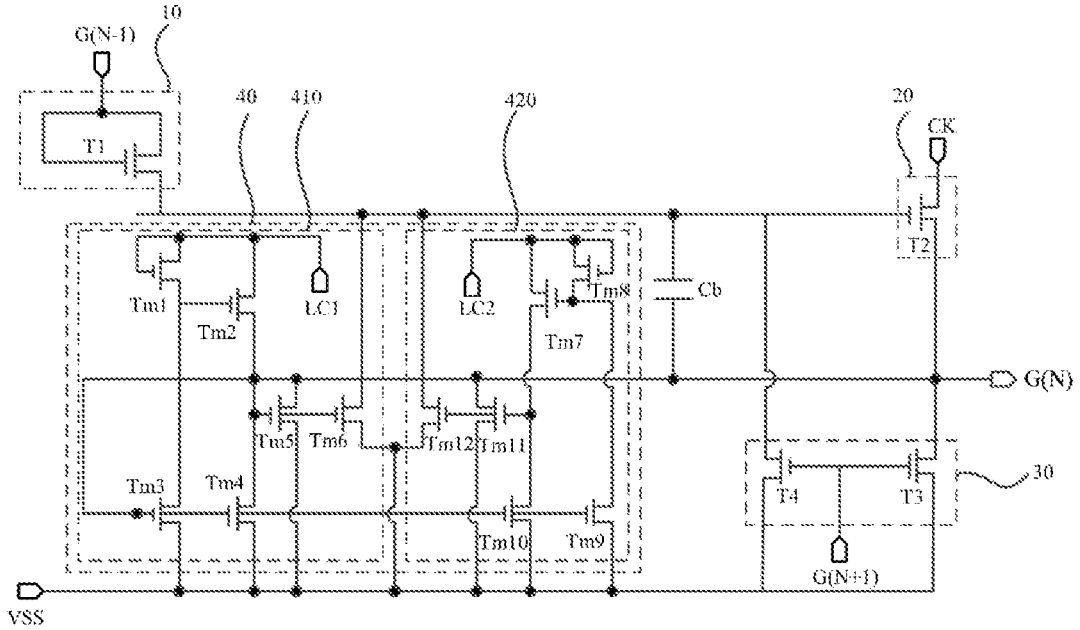
FIG. 2 is a schematic circuit diagram of an Nth stage driving unit in the driving circuit provided by the embodiment of the present disclosure.

Furthermore, as shown in FIG. 2, the pull-up control module 10 comprises a first transistor T1, an input terminal of the first transistor T1 and a gate of the first transistor T1 are both connected to the output terminal G(N−1) of the (N−1)th stage scanning signal, and an output terminal of the first transistor T1 is connected to the first node Q(N).

The pull-up module 20 comprises a second transistor T2, an input terminal of the second transistor T2 is connected to the input terminal of the clock signal CK, a gate of the second transistor T2 is connected to the first node Q(N), and an output terminal of the second transistor T2 is connected to the output terminal G(N) of the Nth stage scanning signal.

The pull-down module 30 comprises a third transistor T3 and a fourth transistor T4, an input terminal of the third transistor T3 and an input terminal of the fourth transistor T4 are connected to the input terminal VSS of the reference low-stage signal, an output terminal of the third transistor T3 is connected to the output terminal G(N) of the Nth stage scanning signal, an output terminal of the fourth transistor T4 is connected to the first node Q(N), and a gate of the third transistor T3 and a gate of the fourth transistor T4 are both connected to the input terminal G(N+1) of the (N+1)th stage scanning signal.

The pull-down maintaining module 40 comprises a first pull-down maintaining sub-module 410 and a second pull-down maintaining sub-module 420, and the first pull-down maintaining sub-module 410 and the second pull-down maintaining sub-module 420 maintain the potential of the first node Q(N) and a potential at the output terminal G(N) of the Nth stage scanning signal after the pull-down module 30 pulls down the potential of the first node Q(N) and the potential at the output terminal G(N) of Nth stage scanning signal.

Specifically, the first pull-down maintaining sub-module 410 comprises a first maintaining transistor Tm1, a second maintaining transistor Tm2, a third maintaining transistor Tm3, an fourth maintaining transistor Tm4, a fifth maintaining transistor Tm5, and a sixth maintaining transistor Tm6.

An input terminal of the first maintaining transistor Tm1, a gate of the first maintaining transistor Tm1, and an input terminal of the second maintaining transistor Tm2 are all connected to the input terminal LC1 of the first control signal. An output terminal of the first maintaining transistor Tm1 and a gate of the second maintaining transistor Tm2 are both connected to an output terminal of the third maintaining transistor Tm3. An input terminal of the third maintaining transistor Tm3, an input terminal of the fourth maintaining transistor Tm4, an input terminal of the fifth maintaining transistor Tm5, and an input terminal of the sixth maintaining transistor Tm6 are all connected to the input terminal VSS of the reference low-stage signal. An output terminal of the second maintaining transistor Tm2, a gate of the third maintaining transistor Tm3, an output terminal of the fourth maintaining transistor Tm4, a gate of the fourth maintaining transistor Tm4, and a gate of the fifth maintaining transistor Tm5, and an output terminal of the fifth maintaining transistor Tm5 are all connected to the output terminal G(N) of the Nth stage scanning signal. An output terminal of the sixth maintaining transistor Tm6 is connected to the first node Q(N).

The second pull-down maintaining sub-module 420 comprises a seventh maintaining transistor Tm7, an eighth maintaining transistor T8, a ninth maintaining transistor Tm9, a tenth maintaining transistor Tm10, an eleventh maintaining transistor Tm11, a twelfth maintaining transistor Tm12.

An input terminal of the seventh maintaining transistor Tm7, an input terminal of the eighth maintaining transistor T8, and a gate of the eighth maintaining transistor T8 are all connected to an input terminal LC2 of the second control signal. A gate of the seventh maintaining transistor Tm7 and the output terminal of the eighth maintaining transistor T8 are both connected to an output terminal of the ninth maintaining transistor Tm9. An input terminal of the ninth maintaining transistor Tm9, an input terminal of the tenth maintaining transistor Tm10, an input terminal of the eleventh maintaining transistor Tm11, and an input terminal of the twelfth maintaining transistor Tm12 are all connected to the input terminal VSS of the reference low-stage signal. An output terminal of the fourteenth T14 transistor, a gate of the eleventh maintaining transistor Tm11, and a gate of the twelfth maintaining transistor Tm12 are all connected to an output terminal of the seventh maintaining transistor Tm7. A gate of the ninth maintaining transistor Tm9, a gate of the tenth maintaining transistor Tm10, and an output terminal of the eleventh maintaining transistor Tm11 are all connected to the output terminal G(N) of the Nth stage scanning signal. An output terminal of the twelfth maintaining transistor Tm12 is connected to the first node Q(N).

Figure 3:
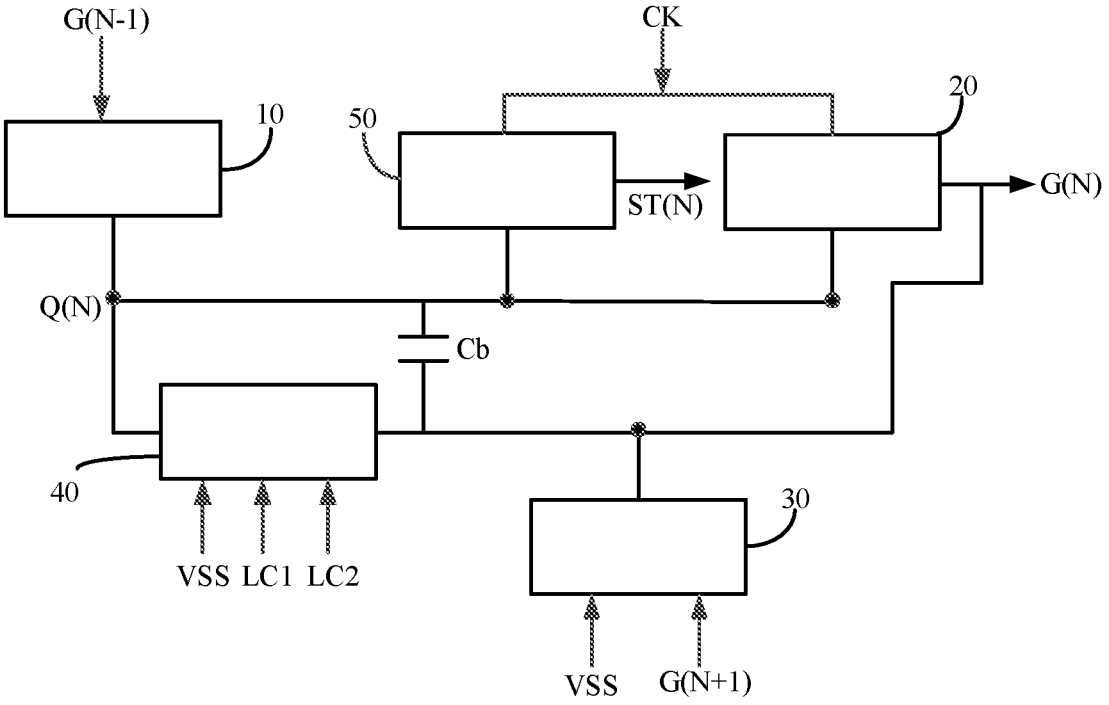
FIG. 3 is a schematic structural diagram of another driving circuit provided by the embodiment of the present disclosure.
Figure 4:
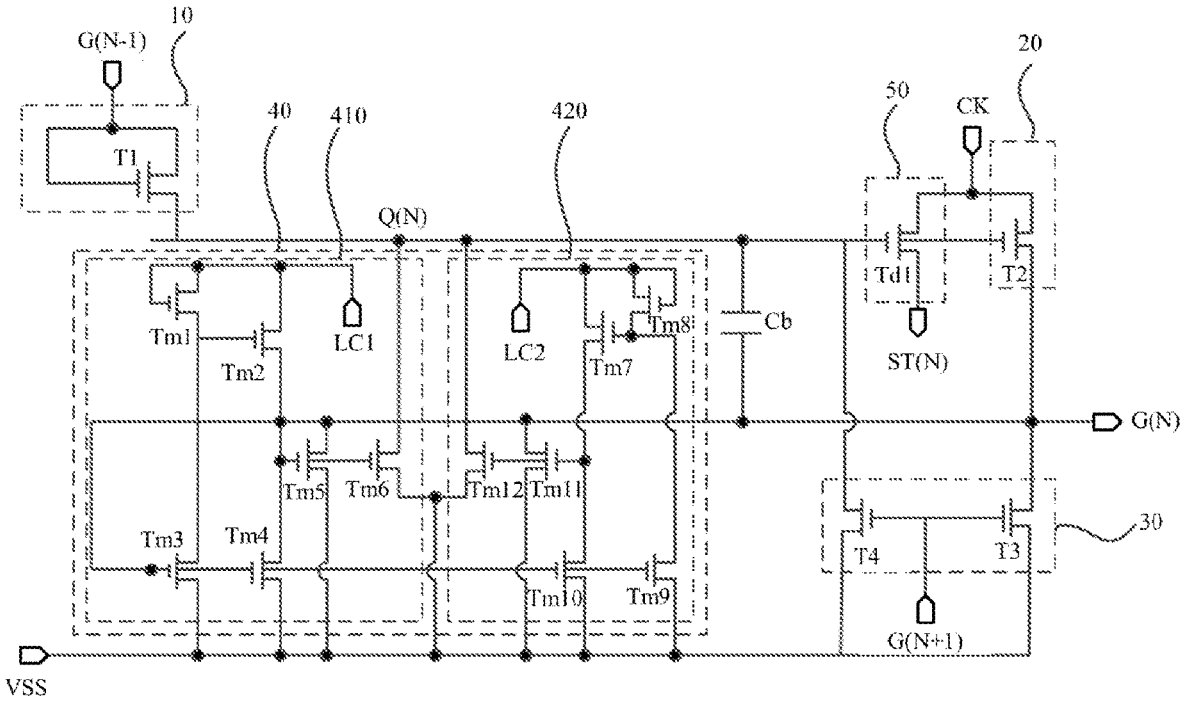
FIG. 4 is a schematic circuit diagram of another Nth stage driving unit in the driving circuit provided by the embodiment of the present disclosure.

Moreover, in combination with FIG. 3 and FIG. 4, the Nth stage driving unit in the embodiment of the present disclosure further comprises a download module 50.

Specifically, the download module 50 is connected to the input terminal CK of the clock signal and is connected to the first node Q(N), and is used to output a stage-transmitting signal at an output terminal ST(N) of an Nth stage-transmitting signal of the driving circuit under the potential control of the first node Q(N).

Furthermore, the download module comprises a first download transistor Td1, an input terminal of the first download transistor Td1 is connected to the input terminal of the second transistor T2, a gate of the first download transistor Td1 is connected to the first node Q(N), and an output terminal of the first download transistor Td1 is connected to the stage-transmitting signal at the output terminal ST(N) of the Nth stage-transmitting signal.

It should be noted that the "connected" described in the embodiment of the present disclosure is "electrically connected". The transistors used in the embodiments of the present disclosure comprise a thin film transistor and a field effect transistor or other devices with same characteristics.

Because sources and drains are symmetrical in the embodiments of the present disclosure, the sources and the drains are interchangeable.

In the embodiment of the present disclosure, signal input terminals are the drains, and signal output terminals are the sources. The transistors used in the embodiments of the present disclosure comprise P-type transistors and/or N-type transistors, wherein the P-type transistors are turned on when gates are low, and are turned off when the gates are high, and the N-type transistors are turned on when the gates are high, and are turned off when the gates are low.

In the driving circuit provided by the embodiment of the present disclosure, stage-transmitting signal lines and control signal lines are simplified, and scanning signal lines are used to transmit signals. Since the scanning signal lines are internal scanning lines, design structure of circuits is greatly simplified, and wiring space of the driving circuit in the display panel is reduced without adding a new wiring. On the one hand, structural cost of the circuits is saved, and on the other hand, structural size of the driving circuit can be reduced, so that the display panel has a narrower frame structure.

In the driving circuit of the present disclosure, when the input terminal LC1 of the first control signal is at a low stage, the input terminal LC2 of the second control signal is at a high stage; and the input terminal LC1 of the first control signal is at a high stage, the input terminal LC2 of the second control signal is at a low stage.

Figure 5:
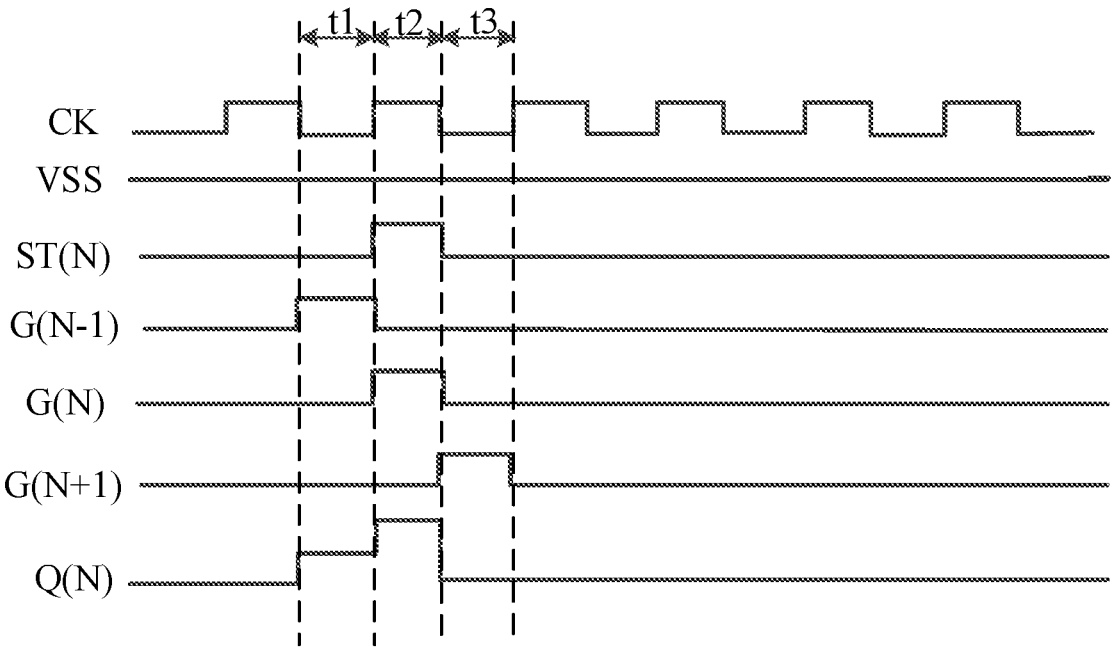
FIG. 5 is a signal timing diagram of the Nth stage driving unit of the driving circuit provided by the embodiment of the present disclosure.

Specifically, as shown in FIG. 5, during a t1 timing stage, when the scanning signal at the output terminal G(N−1) of the (N−1)th stage scanning signal is at a high stage and the first transistor T1 is turned on, the scanning signal at the output terminal G(N−1) of the (N−1)th stage scanning signal input by the input terminal of the first transistor T1 is at a high stage, so that the potential of the first node Q(N) is pulled up. When the second transistor T2 and the first download transistor Td1 are turned on, a signal at the input terminal CK of the clock signal is at a low stage, so a scanning signal at the output terminal G(N) of the Nth scanning signal and a signal at the output terminal ST(N) of the Nth stage-transmitting signal are both at a low stage.

During a t2 timing stage, when the scanning signal at the output terminal G(N−1) of the (N−1)th stage scanning signal is at a low stage and the first transistor T1 is turned off, and the potential of the first node Q(N) maintains at a high stage and the second transistor T2 and the first download transistor Td1 keep being turned on, the signal at the input terminal CK of the clock signal is at a high stage. Therefore, the scanning signal at the output terminal G(N) of the Nth stage scanning signal and the signal at the output terminal ST(N) of the Nth stage-transmitting signal are both at a high stage. At the present timing, the scanning signal at the output terminal G(N) of the Nth stage scanning signal and the signal at the output terminal ST(N) of the Nth stage-transmitting signal are both at a high stage, so that scanning lines corresponding to the Nth stage driving unit are charged, and a column of pixels corresponding to the output terminal G(N) of the Nth stage scanning signal of the driving circuit is turned on, and the column of pixels are lighted up.

Simultaneously, at the present timing, since the scanning signal at the output terminal G(N) of the Nth stage scanning signal is at a high stage, the potential of the first node Q (N) is further raised by the bootstrap capacitor Cb, which ensures that the second transistor T2 and the first download transistor Td1 are turned on, and the scanning signal at the output terminal G(N) of the Nth stage scanning signal and the signal at the output terminal ST(N) of the Nth stage-transmitting signal are both at a high stage.

During a t3 timing stage, the signal at the input terminal CK of the clock signal is at a low stage, and the signal at the output terminal ST(N) of the Nth stage-transmitting signal and the scanning signal at the output terminal G(N) of the Nth stage scanning signal are both at a high stage.

Moreover, at the present timing, since the scanning signal at the input terminal G(N+1) of the (N+1)th stage scanning signal is at a high stage, the third transistor T3 and the fourth transistor T4 are turned on, and the scanning signal of the first node Q(N) and the scanning signal at the output terminal G(N) of the Nth stage scanning signal are directly connect to the signal at the input terminal VSS of the reference low-stage signal; that is, a potential of the scanning signal of the first node Q(N) and the potential of the scanning signal at the output terminal G(N) of the Nth stage scanning signal are pulled down to the potential of the signal at the input terminal VSS of the reference low-stage signal.

Because the potential of the first node Q(N) is pulled low, the third maintaining transistor Tm3 and the fourth maintaining transistor Tm4 are turned off. If the first control signal LC1 is at a high stage and the second control signal LC2 is at a low stage, the first maintaining transistor Tm1 and the second maintaining transistor Tm2 are turned on, and the fifth maintaining transistor Tm5 and the sixth maintaining transistor Tm6 are turned on. Furthermore, the scanning signal of the first node Q(N) and the scanning signal at the output terminal G(N) of the Nth stage scanning signal are connected to the signal at the input terminal VSS of the reference low-stage signal, thereby maintaining the potential of the first node Q(N) and the potential of the signal at the output terminal G(N) of the Nth stage scanning signal at the input terminal VSS of the reference low-stage signal.

In the similar way, if the second control signal LC2 is at a high stage and the first control signal LC1 is at a low stage, the second pull-down maintaining sub-module 420 is used to maintain the potential of the first node Q(N) and the potential of the signal at the output terminal G(N) of the Nth stage scanning signal at the input terminal VSS of the reference low-stage signal, and its working principle is similar to the first pull-down maintenance sub-module 410. In the embodiment of the present disclosure, a polarity of the signal at the output terminal ST(N) of the Nth stage-transmitting signal is same as a polarity of the output terminal G(N) of the Nth stage scanning signal, so that the output terminal G(N) of the Nth stage scanning signal is removed, thereby simplifying wrings of the driving circuit and achieving a narrow frame design.

Figure 6:
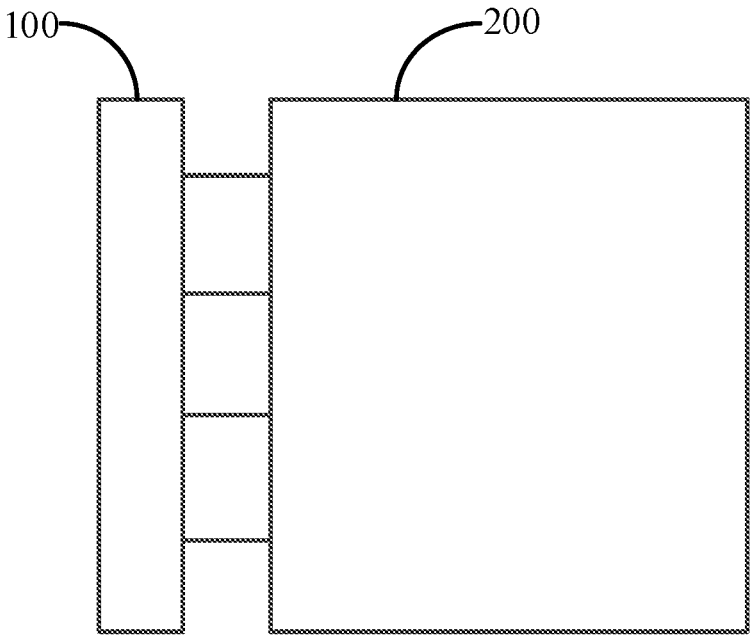
FIG. 6 is a schematic structural diagram of a display panel provided by the embodiment of the present disclosure.

As shown in FIG. 6, the embodiment of the present disclosure further provides a display panel, and the display panel comprises the driving circuit 100 and the pixel array 200 of the display panel.

Compared with the prior art, driving units of a driving circuit in an embodiment of the present disclosure comprise a pull-up control module, a pull-up module, a pull-down module, a pull-down maintaining module, and a bootstrap capacitor. The pull-up control module and the pull-down module are connected to scanning lines to be used for outputting scanning signals. In the driving circuit provided by the embodiment of the present disclosure, stage-transmitting signal lines and control signal lines are simplified, and scanning signal lines are used to transmit signals. Since the scanning signal lines are internal scanning lines, design structure of circuits is greatly simplified, and wiring space of the driving circuit in the display panel is reduced without adding a new wiring. On the one hand, structural cost of the circuits is saved, and on the other hand, structural size of the driving circuit can be reduced, so that the display panel has a narrower frame structure.

As mentioned above, while the present disclosure has been disclosed via preferred embodiments as above, the preferred embodiments are not intended to limit the disclosure. Those skilled in the art can make various modifications and alternations without departing from the spirit and scope of the disclosure. The scope of protection of the disclosure is defined by the claims.

What is claimed is:

1. A driving circuit, comprising at least two gate driving units, wherein at least two of the gate driving units are connected in a cascade arrangement; and an Nth stage driving unit in the at least two of the gate driving units comprises:

a pull-up control circuit, a pull-up circuit, a pull-down circuit, a pull-down maintaining circuit, and a bootstrap capacitor, wherein N is an integer greater than 0;

the pull-up control circuit is connected to an output terminal of an (N−1)th stage scanning signal of the driving circuit and is connected to a first node in the Nth stage driving unit, and is configured to output a scanning signal at the output terminal of the (N−1)th stage scanning signal to the first node;

the pull-up circuit is connected to an input terminal of a clock signal and is connected to the first node, and is configured to pull up a potential of a scanning signal at an output terminal of an Nth stage scanning signal of the driving circuit under a potential control of the first node;

the pull-down circuit is connected to an input terminal of an (N+1)th stage scanning signal of the driving circuit and an input terminal of a reference low-stage signal of the driving circuit and is connected to the first node and the output terminal of an Nth stage scanning signal, and is configured to pull down a potential of the first node and a potential of the scanning signal at the output terminal of the Nth stage scanning signal according to a scanning signal at the input terminal of the (N+1)th stage scanning signal and the potential of the scanning signal at the output terminal of the Nth stage scanning signal;

the pull-down maintaining circuit is connected to an input terminal of a first control signal, an input terminal of a second control signal, and the input terminal of the reference low-stage signal and is connected to the first node and the output terminal of the Nth stage scanning signal, and is configured to maintain the potential of the first node and the potential of the scanning signal at the output terminal of the Nth stage scanning signal at a potential of a signal at the input terminal of the reference low-stage signal after the pull-down circuit pulls down the potential of the first node and the potential of the scanning signal at the output terminal of the Nth stage scanning signal, wherein the pull-down maintaining circuit comprises a first pull-down maintaining sub-circuit and a second pull-down maintaining sub-circuit, and wherein the first pull-down maintaining sub-circuit and the second pull-down maintaining sub-circuit are configured to maintain the potential of the first node and a potential at the output terminal of the Nth stage scanning signal after the pull-down circuit pulls down the potential of the first node and the potential at the output terminal of Nth stage scanning signal; and one terminal of the bootstrap capacitor is connected to the first node, and another terminal of the bootstrap capacitor is connected to the output terminal of the Nth stage scanning signal;

wherein the first pull-down maintaining sub-circuit comprises a first maintaining transistor, a second maintaining transistor, a third maintaining transistor, a fourth maintaining transistor, a fifth maintaining transistor, and a sixth maintaining transistor;

an input terminal of the first maintaining transistor, a gate of the first maintaining transistor, and an input terminal of the second maintaining transistor are all connected to the input terminal of the first control signal;

an output terminal of the first maintaining transistor and a gate of the second maintaining transistor are both connected to an output terminal of the third maintaining transistor;

an input terminal of the third maintaining transistor, an input terminal of the fourth maintaining transistor, an input terminal of the fifth maintaining transistor, and an input terminal of the sixth maintaining transistor are all connected to the input terminal of the reference low-stage signal;

an output terminal of the second maintaining transistor, a gate of the third maintaining transistor, an output terminal of the fourth maintaining transistor, a gate of the fourth maintaining transistor, and a gate of the fifth maintaining transistor, and an output terminal of the fifth maintaining transistor are all connected to the output terminal of the Nth stage scanning signal; and an output terminal of the sixth maintaining transistor is connected to the first node; and the second pull-down maintaining sub-circuit comprises a seventh maintaining transistor, an eighth maintaining transistor, a ninth maintaining transistor, a tenth maintaining transistor, an eleventh maintaining transistor, a twelfth maintaining transistor;

an input terminal of the seventh maintaining transistor, an input terminal of the eighth maintaining transistor, and a gate of the eighth maintaining transistor are all connected to an input terminal of the second control signal;

a gate of the seventh maintaining transistor and the output terminal of the eighth maintaining transistor are both connected to an output terminal of the ninth maintaining transistor;

an input terminal of the ninth maintaining transistor, an input terminal of the tenth maintaining transistor, an input terminal of the eleventh maintaining transistor, and an input terminal of the twelfth maintaining transistor are all connected to the input terminal of the reference low-stage signal;

an output terminal of the tenth maintaining transistor, a gate of the eleventh maintaining transistor, and a gate of the twelfth maintaining transistor are all connected to an output terminal of the seventh maintaining transistor;

a gate of the ninth maintaining transistor, a gate of the tenth maintaining transistor, and an output terminal of the eleventh maintaining transistor are all connected to the output terminal of the Nth stage scanning signal; and an output terminal of the twelfth maintaining transistor is connected to the first node.

2. The driving circuit as claimed in claim 1, wherein the Nth stage driving unit comprises a download circuit, the download circuit is connected to the input terminal of the clock signal and is connected to the first node, and is configured to output a stage-transmitting signal at an output terminal of an Nth stage-transmitting signal of the driving circuit under the potential control of the first node.

3. The driving circuit as claimed in claim 2, wherein the download circuit comprises a first download transistor, an input terminal of the first download transistor is connected to the input terminal of the second transistor, a gate of the first download transistor is connected to the first node, and an output terminal of the first download transistor is connected to the stage-transmitting signal at the output terminal of the Nth stage-transmitting signal.

4. The driving circuit as claimed in claim 1, wherein the pull-up control circuit comprises a first transistor, an input terminal of the first transistor and a gate of the first transistor are both connected to the output terminal of the (N−1)th stage scanning signal, and an output terminal of the first transistor is connected to the first node.

5. The driving circuit as claimed in claim 1, wherein the pull-up circuit comprises a second transistor, an input terminal of the second transistor is connected to the input terminal of the clock signal, a gate of the second transistor is connected to the first node, and an output terminal of the second transistor is connected to the output terminal of the Nth stage scanning signal.

6. The driving circuit as claimed in claim 1, wherein the pull-down circuit comprises a third transistor and a fourth transistor, an input terminal of the third transistor and an input terminal of the fourth transistor are connected to the input terminal of the reference low-stage signal, an output terminal of the third transistor is connected to the output terminal of the Nth stage scanning signal, an output terminal of the fourth transistor is connected to the first node, and a gate of the third transistor and a gate of the fourth transistor are both connected to the input terminal of the (N+1)th stage scanning signal.

7. The driving circuit as claimed in claim 1, wherein when the input terminal of the first control signal is at a low stage, the input terminal of the second control signal is at a high stage; and when the input terminal of the first control signal is at a high stage, the input terminal of the second control signal is at a low stage.

8. A display panel, comprising a driving circuit and a pixel array, wherein the driving circuit comprises at least two gate driving units, and at least two of the gate driving units are connected in a cascade arrangement; and an Nth stage driving unit in the at least two of the gate driving units comprises:

a pull-up control circuit, a pull-up circuit, a pull-down circuit, a pull-down maintaining circuit, and a bootstrap capacitor, wherein N is an integer greater than 0;

the pull-up control circuit is connected to an output terminal of an (N−1)th stage scanning signal of the driving circuit and is connected to a first node in the Nth stage driving unit, and is configured to output a scanning signal at the output terminal of the (N−1)th stage scanning signal to the first node;

the pull-up circuit is connected to an input terminal of a clock signal and is connected to the first node, and is configured to pull up a potential of a scanning signal at an output terminal of an Nth stage scanning signal of the driving circuit under a potential control of the first node;

the pull-down circuit is connected to an input terminal of an (N+1)th stage scanning signal of the driving circuit and an input terminal of a reference low-stage signal of the driving circuit and is connected to the first node and the output terminal of an Nth stage scanning signal, and is configured to pull down a potential of the first node and a potential of the scanning signal at the output terminal of the Nth stage scanning signal according to a scanning signal at the input terminal of the (N+1)th stage scanning signal and the potential of the scanning signal at the output terminal of the Nth stage scanning signal;

the pull-down maintaining circuit is connected to an input terminal of a first control signal, an input terminal of a second control signal, and the input terminal of the reference low-stage signal and is connected to the first node and the output terminal of the Nth stage scanning signal, and is configured to maintain the potential of the first node and the potential of the scanning signal at the output terminal of the Nth stage scanning signal at a potential of a signal at the input terminal of the reference low-stage signal after the pull-down circuit pulls down the potential of the first node and the potential of the scanning signal at the output terminal of the Nth stage scanning signal, wherein the pull-down maintaining circuit comprises a first pull-down maintaining sub-circuit and a second pull-down maintaining sub-circuit, and wherein the first pull-down maintaining sub-circuit and the second pull-down maintaining sub-circuit are configured to maintain the potential of the first node and a potential at the output terminal of the Nth stage scanning signal after the pull-down circuit pulls down the potential of the first node and the potential at the output terminal of Nth stage scanning signal; and one terminal of the bootstrap capacitor is connected to the first node, and another terminal of the bootstrap capacitor is connected to the output terminal of the Nth stage scanning signal;

wherein the first pull-down maintaining sub-circuit comprises a first maintaining transistor, a second maintaining transistor, a third maintaining transistor, a fourth maintaining transistor, a fifth maintaining transistor, and a sixth maintaining transistor;

an input terminal of the first maintaining transistor, a gate of the first maintaining transistor, and an input terminal of the second maintaining transistor are all connected to the input terminal of the first control signal;

an output terminal of the first maintaining transistor and a gate of the second maintaining transistor are both connected to an output terminal of the third maintaining transistor;

an input terminal of the third maintaining transistor, an input terminal of the fourth maintaining transistor, an input terminal of the fifth maintaining transistor, and an input terminal of the sixth maintaining transistor are all connected to the input terminal of the reference low-stage signal;

an output terminal of the second maintaining transistor, a gate of the third maintaining transistor, an output terminal of the fourth maintaining transistor, a gate of the fourth maintaining transistor, and a gate of the fifth maintaining transistor, and an output terminal of the fifth maintaining transistor are all connected to the output terminal of the Nth stage scanning signal; and an output terminal of the sixth maintaining transistor is connected to the first node; and the second pull-down maintaining sub-circuit comprises a seventh maintaining transistor, an eighth maintaining transistor, a ninth maintaining transistor, a tenth maintaining transistor, an eleventh maintaining transistor, a twelfth maintaining transistor;

an input terminal of the seventh maintaining transistor, an input terminal of the eighth maintaining transistor, and a gate of the eighth maintaining transistor are all connected to an input terminal of the second control signal;

a gate of the seventh maintaining transistor and the output terminal of the eighth maintaining transistor are both connected to an output terminal of the ninth maintaining transistor;

an input terminal of the ninth maintaining transistor, an input terminal of the tenth maintaining transistor, an input terminal of the eleventh maintaining transistor, and an input terminal of the twelfth maintaining transistor are all connected to the input terminal of the reference low-stage signal;

an output terminal of the tenth maintaining transistor, a gate of the eleventh maintaining transistor, and a gate of the twelfth maintaining transistor are all connected to an output terminal of the seventh maintaining transistor;

a gate of the ninth maintaining transistor, a gate of the tenth maintaining transistor, and an output terminal of the eleventh maintaining transistor are all connected to the output terminal of the Nth stage scanning signal; and an output terminal of the twelfth maintaining transistor is connected to the first node.

9. The display panel as claimed in claim 8, wherein the Nth stage driving unit comprises a download circuit, the download circuit is connected to the input terminal of the clock signal and is connected to the first node, and is configured to output a stage-transmitting signal at an output terminal of an Nth stage-transmitting signal of the driving circuit under the potential control of the first node.

10. The display panel as claimed in claim 9, wherein the download circuit comprises a first download transistor, an input terminal of the first download transistor is connected to the input terminal of the second transistor, a gate of the first download transistor is connected to the first node, and an output terminal of the first download transistor is connected to the stage-transmitting signal at the output terminal of the Nth stage-transmitting signal.

11. The display panel as claimed in claim 8, wherein the pull-up control circuit comprises a first transistor, an input terminal of the first transistor and a gate of the first transistor are both connected to the output terminal of the (N−1)th stage scanning signal, and an output terminal of the first transistor is connected to the first node.

12. The display panel as claimed in claim 8, wherein the pull-up circuit comprises a second transistor, an input terminal of the second transistor is connected to the input terminal of the clock signal, a gate of the second transistor is connected to the first node, and an output terminal of the second transistor is connected to the output terminal of the Nth stage scanning signal.

13. The display panel as claimed in claim 8, wherein the pull-down circuit comprises a third transistor and a fourth transistor, an input terminal of the third transistor and an input terminal of the fourth transistor are connected to the input terminal of the reference low-stage signal, an output terminal of the third transistor is connected to the output terminal of the Nth stage scanning signal, an output terminal of the fourth transistor is connected to the first node, and a gate of the third transistor and a gate of the fourth transistor are both connected to the input terminal of the (N+1)th stage scanning signal.

14. The display panel as claimed in claim 8, wherein when the input terminal of the first control signal is at a low stage, the input terminal of the second control signal is at a high stage; and when the input terminal of the first control signal is at a high stage, the input terminal of the second control signal is at a low stage.

* * * * *